US011851265B2

(12) United States Patent
Veenje et al.

(10) Patent No.: US 11,851,265 B2
(45) Date of Patent: Dec. 26, 2023

(54) PACKAGING UNIT FROM A MOULDED PULP MATERIAL WITH DISPLAY OPENINGS AND METHOD FOR MANUFACTURING SUCH PACKAGING UNIT

(71) Applicant: HUHTAMAKI MOLDED FIBER TECHNOLOGY B.V., Leeuwarden (NL)

(72) Inventors: Sandor Klaas Veenje, Workum (NL); Jelmer Gerhard Jan Van Der Meij, Sneek (NL)

(73) Assignee: HUHTAMAKI MOLDED FIBER TECHNOLOGY B.V., Leeuwarden (NL)

( * ) Notice: Subject to any disclaimer, the term of this patent is extended or adjusted under 35 U.S.C. 154(b) by 0 days.

(21) Appl. No.: 17/787,325

(22) PCT Filed: Dec. 9, 2020

(86) PCT No.: PCT/NL2020/050767
§ 371 (c)(1),
(2) Date: Jun. 19, 2022

(87) PCT Pub. No.: WO2021/125940
PCT Pub. Date: Jun. 24, 2021

(65) Prior Publication Data

US 2023/0016230 A1 Jan. 19, 2023

(30) Foreign Application Priority Data

Dec. 20, 2019 (NL) ..... 2024536

(51) Int. Cl.
*B65D 85/32* (2006.01)

(52) U.S. Cl.
CPC ..... *B65D 85/324* (2013.01)

(58) Field of Classification Search
CPC .... B65D 85/32; B65D 85/322; B65D 85/324; B65D 85/321
(Continued)

(56) References Cited

U.S. PATENT DOCUMENTS 2,045,771 A 6/1936 Graham
2,226,904 A * 12/1940 Gates ..... B65D 85/322 217/26.5
(Continued)

FOREIGN PATENT DOCUMENTS

EP 1389590 A1 2/2004
GB 846823 A 8/1960
(Continued)

*Primary Examiner* — Rafael A Ortiz
(74) *Attorney, Agent, or Firm* — Husch Blackwell LLP

(57) ABSTRACT

The present invention relates to a packaging unit (2) from a moulded pulp material, the packaging unit comprising a bottom part (4) with product receiving compartments for holding respective products, and a number of cones that are provided between the compartments, and having at least one bottom display surface, and a cover part (6) that is hingedly connected to the bottom part with a hinge-element (26), and having at least one cover display surface, wherein the packaging unit comprises a lock (28) for locking the bottom and cover parts in a closed position, wherein the bottom front surface and cover display surface comprise a number of display openings (42, 44, 46) that are positioned to display the product in the respective compartment, wherein the display openings in the bottom front surface and cover display surface are aligned, wherein the lock comprises a lock opening (32) and a cam element (30), and wherein the cam element is provided on a flapless front surface of the bottom part.

15 Claims, 6 Drawing Sheets

(58) Field of Classification Search
USPC ..... 206/521.1, 521, 1.5
See application file for complete search history.

(56) References Cited

U.S. PATENT DOCUMENTS

| | | | | | |
|---|---|---|---|---|---|
| 3,647,132 | A | | 3/1972 | Crabtree | |
| 3,672,693 | A | * | 6/1972 | Weir | B65D 85/324 206/521.1 |
| 4,462,537 | A | * | 7/1984 | Grootherder | B65D 85/32 206/505 |

FOREIGN PATENT DOCUMENTS

| | | | | | |
|---|---|---|---|---|---|
| GB | 1113339 | A | | 5/1968 | |
| GB | 1347946 | A | | 2/1974 | |
| GB | 2032888 | A | * | 5/1980 | B65D 85/324 |
| GB | 2032888 | A | | 5/1980 | |
| WO | WO-2013141687 | A1 | * | 9/2013 | B65D 1/265 |

* cited by examiner

PACKAGING UNIT FROM A MOULDED PULP MATERIAL WITH DISPLAY OPENINGS AND METHOD FOR MANUFACTURING SUCH PACKAGING UNIT

The present invention relates to a packaging unit that is made of moulded pulp material. These packaging units are used for products like eggs.

Packaging units for eggs, such as egg cases, containers or cartons, are known in practice and are generally manufactured from a moulded pulp material that originates from cellulose fibres. Such packaging units comprise a bottom part that is provided with compartments for individual products, and a cover part that is often hingedly connected to the bottom part. The products, like eggs, are stored, transported and displayed in these packaging units. An example of such egg case is shown in WO2015/160248 A1 that shows a packaging unit comprising bottom and cover parts that are hingedly connected and that further comprises a lock that is configured for locking the cover part and the bottom part in a closed position of the packaging unit.

Often, the products like eggs are placed on a shelf in a shop/supermarket, for example. Potential buyers take the egg case from the shelf for inspections, for example. However, inspection of the products involves opening of the egg case. This requires the potential buyer to manually open the egg case to inspect the products. In addition, this has the risk of damaging the products.

The present invention has for its object to obviate or at least reduce the above stated problems in conventional packaging units, such as egg cases, and to provide a suitable packaging unit enabling convenient display of products.

The present invention provides for this purpose a packaging unit from a moulded pulp material, wherein the packaging unit according to the present invention comprising:

- a bottom part with product receiving compartments for holding respective products, and a number of cones that are provided between the compartments, and having at least one bottom front surface; and
- a cover part that is hingedly connected to the bottom part with a hinge-element, and having at least one cover display surface,
- wherein the packaging unit comprises a lock for locking the bottom and cover parts in a closed position, and
- wherein at least one of the bottom front surface and cover display surface comprise a number of display openings that are positioned to display the product in the respective compartment,
- wherein the display openings in the bottom front surface and cover display surface are aligned,
- wherein the lock comprising a lock opening and a cam element, and
- wherein the cam element is provided on a flapless front surface of the bottom part.

The packaging unit according to the invention is manufactured from a moulded pulp material that may originate from soft wood fibres and/or hard wood fibres and/or recycled cellulose fibres and/or other suitable fibres. The packaging unit comprises a bottom part and a cover part that are hingedly connected to each other with a hinge-element, such as a hinge. The bottom part is provided with product holding compartments that are capable of receiving and holding respective products, such as eggs and also similar products like kiwis and tomatoes, for example. Between adjacent compartments one or more cones are provided to give additional support to the packaging unit. In a presently preferred embodiment the bottom part and cover part of the packaging unit comprise a front surface, a back surface, and two side surfaces. In addition, the bottom part comprises a bottom surface and the cover part comprises a top surface.

In a closed position of the packaging unit according to the invention, the bottom part and cover part are locked together with a lock. The lock comprises a first lock element and a second lock element that are provided on the respective bottom and cover part. In a presently preferred embodiment, the cover part is provided with a lock opening and the bottom part is provided with a locking cam that are configured to engage each other in the closed position of the packaging unit.

The packaging unit according to the present invention further comprises at least one bottom front surface and at least one cover display surface. These display surfaces are designed to be shown towards a potential buyer when being stacked on a shelf in a shop or supermarket, for example. Preferably, the front surfaces of the bottom and/or cover part are at least partly providing a display surface. Optionally, also the back surfaces of the bottom and/or cover parts may comprise a display surface. It will be understood that also other designs for the packaging unit can be envisaged, such as a triangular packaging unit wherein one (or two or more) of the sides may provide display surfaces, for example. According to the invention, the at least one display surface comprises a number of display openings, wherein the display openings in the bottom part front surface and the cover part display surface are positioned such that they display the product that is received in the respective compartment.

Providing display openings in the display surfaces enables a potential buyer to view and/or inspect the products without having to open the packaging unit. Furthermore, this even enables the potential buyer to evaluate the products while the products with the packaging unit remain on the shelf. This is less time-consuming for the potential buyer. In addition, this reduces the risk of damaging the products, for example.

As a further advantage, the display openings provide additional cooling for the products. This increases the shelf life of the vulnerable products, like eggs. As an even further advantage, the display openings enable improved drying to enable removal of moisture from the products and/or packaging unit such that weakening of the packaging unit is prevented. Therefore, the packaging unit substantially maintains its strength during storage, transport and display of the products.

The aforementioned advantages are especially relevant for consumer products like eggs. The advantages in relation to the enhanced cooling and/or drying are especially relevant when handling boiled eggs. It is noted that these boiled eggs are sometimes provided with a coloured layer or even a coloured protective layer. The display openings in the packaging unit according to the present invention provide a consumer with a view on the coloured eggs. This improves the overall visual appearance of the packaging unit with the coloured products. In addition, the use of the coloured products renders inspection of the products in relation to cracks etcetera more easy.

According to the invention the display openings in the bottom front surface and cover display surface are aligned.

Aligning the display openings in the respective bottom front surface and cover display surface results in a substantial view of the product in the compartment for a potential buyer, for example. Preferably, the display openings in the bottom front surface and cover display surface are located such that a potential buyer can easily see the product in a compartment.

In a presently preferred embodiment the aligned display openings resemble an egg-shape. The egg-shape provides a pleasant visual appearance for a potential buyer wherein the display openings reflect the shape of the products that are placed and/or can be placed inside the packaging unit. Furthermore, the egg-shape provides substantial strength to the packaging unit as compared to other possible shapes for an opening. More specifically, loads from a stack of packaging units that are placed on top of each other can easily be transferred further without damaging the packaging unit. This will also prevent damaging the products that are packed in the packaging unit.

Preferably, the display opening in the bottom front surface extends over at least ⅔ of the height of the bottom part.

Having the display opening in the bottom front surface extending over at least ⅔ of the height enables an effective egg packing operation. More specifically, fingers or other clamping elements of the packing robot are positioned further into the bottom part (as seen in the vertical direction) before disengaging the egg and may exit the egg compartment (partly) through the opening. Therefore, the "falling distance" of the egg is significantly reduced. This reduces the risk of damaging the egg.

According to the invention the lock of the packaging unit comprises a lock opening and a cam element. In a presently preferred embodiment of the invention, in a closed position, the lock substantially lies behind the front plane of the packaging unit.

By providing the lock substantially behind the front plane of the packaging unit the risk of hooking of cams to other packaging units or other elements is substantially reduced. In a manufacturing process this reduces the risk of a standstill of the operation. Also, this reduces the risk of damaging the cams of the lock. This significantly contributes to reducing the risk of a lock not functioning properly during use.

Preferably, the lock opening comprises a support surface that is configured for engaging the cam. Providing an additional support surface gives an additional strength to the packaging unit. This additional strength obviates the use of additional moulded pulp material to maintain the strength of the packaging unit with the display openings.

According to the invention the cam element is provided on a flapless front surface of the bottom part. By providing the cam element on a flapless front surface the cam element is actually provided directly on the bottom part. This provides additional strength when the cam engages the support surface of the opening in a closed position of the packaging unit. It will be understood that this also substantially improves the strength of the overall packaging unit.

In a further preferred embodiment of the invention the display surface with the lock comprises a display extension that is positioned substantially below the opening.

Providing a display extension gives a visual indication of the location of the lock. This assists the consumer with locking and unlocking the packaging unit. Furthermore, when closing the packaging unit the display extension provides a so-called seeking function such that the opening in the cover part is guided over the cam element in the bottom part. This renders it easier to close the packaging unit. More specifically, it prevents the cover part being positioned erroneously relative to the bottom part. Therefore, this display extension contributes to the lock security or lock robustness. An even further effect of the display extension is the introduction of a lever function for the lock. This further assists a consumer with the opening of the packaging unit.

In a further preferred embodiment of the invention, the packaging unit comprises a hinge-element, such as a hinge, for hingedly connecting the bottom part and the cover part, wherein the hinge-element comprises a cover support part and a bottom support part.

By providing one or more cover support parts and bottom support parts in association with the hinge-element, the strength of the packaging unit is further improved. More specifically, these cover support and bottom support parts prevent shifting of the lid of the cover part in a substantially horizontal direction relative to the bottom part. This provides a more secure stacking.

In a further preferred embodiment of the invention the bottom part comprises a substantially horizontally extending bottom support surface on the display surface, wherein the bottom support surface is configured for engaging the cover part. Preferably, the cover part comprises a substantially horizontally extending cover support surface that is also provided close to or at the display surface and is configured for engaging the bottom support surface.

Providing a bottom support surface and more preferably a combination of the bottom support surface and cover support surface provides additional strength to the packaging unit. This reduces the risk of damaging to the packaging unit and/or the product therein.

In a further preferred embodiment of the invention at least some of the cones are provided with one or more openings and are configured to enable a gas stream, such as an air stream, to pass through the openings.

The cone (partly) separates adjacent compartments and preferably supports the product(s). The cone may comprise a cone-element and/or equivalent separator between adjacent compartments. Providing an opening in the cone enables a gas flow, preferably an air flow, through the cone. In the manufacturing process this significantly contributes to the drying process of the packaging unit. Therefore, the drying of the packaging unit is significantly improved. In addition, the drying operation of the packaging unit is more controlled and/or gradually performed. The improved drying increases the strength of the packaging unit without increasing the required amount of material and/or reduces the amount of material, while maintaining the strength of the packaging unit.

A further effect of providing the cones of the packaging units with one or more openings is the reduced overall weight of the packaging unit. This reduces the material costs, and may reduce drying costs and/or may improve handling of the packaging unit. For example, for a standard egg package the weight reduction may amount to about 1 gram.

As a further effect of providing the cones of the packaging unit with one or more openings is the reduction in product damage during storage, transport and/or display. This is specifically relevant for vulnerable products like eggs. The increased strength of the packaging unit therefore reduces product loss.

In a presently preferred embodiment of the invention the openings have an effective diameter in the range of 0.5-15 mm, preferably in the range of 1.0-10 mm, more preferably in the range of 2.0-8 mm, and most preferably in the range of 3-6 mm.

Experiments showed that providing openings with an effective diameter, or opening size, in the mentioned range achieves an increased strength due to the improved drying operation. The openings are preferably shaped as a circle having a diameter. This diameter corresponds to the effective diameter. It will be understood that other shapes for an opening are also possible. For example, the opening may be an ellipse. In such case the effective diameter corresponds to the diameter of a circular opening having an equal opening surface.

In a presently preferred embodiment of the invention at least some of the openings are provided at or close to the top of the cone. Providing at least some of the openings at or close to the top of the cone achieves an effective drying operation. This further enhances the strength of the packaging unit.

In a further preferred embodiment of the invention the hinge of the packaging unit comprises an indent.

By providing an indent the connection between the cover part the bottom part is improved and denesting is further improved.

Preferably, the cover part comprises a substantially planar top surface. Such planar top surface assists in providing the potential buyer or consumer with information about the product, for example. Furthermore, this also enables providing a printing area on the inner side of the top surface. This enables providing the consumer with additional information about the product, for example.

In a presently preferred embodiment of the invention, the moulded pulp material comprises an amount of natural fibres.

Additionally, or alternatively, the moulded pulp material comprises an amount of a biodegradable material, such as an aliphatic polyester.

The application of natural fibers and/or biodegradable material in a packaging unit from a moulded pulp material is described in WO 2018/067006 A1 of the same applicant. The use of natural fibers and/or biodegradable material results in packaging units that are substantially MOSH and/or MOAH free, and/or are (home) compostable. These materials are preferably applied in combination with one or more of the aforementioned features, especially one or more of the support surfaces, display extension, support surface, and support parts. Such combination provides additional strength to the packaging units providing more possibilities to use alternative materials without reducing the behavior of the packaging units.

The present invention further relates to a method for packing products like eggs, comprising the steps of providing a packaging unit as described above, and placing therein one or more of the products.

Such method provides the same effects and advantages as described with respect of the packaging unit.

The present invention further relates to a method for manufacturing a packaging unit from a moulded pulp material, the method comprising the steps of:

preparing a moulded pulp material; and providing a packaging unit according to any of the embodiment of the invention.

Such method provides the same effects and advantages as described with respect to the packaging unit.

Further advantages, features and details of the invention are elucidated on the basis of preferred embodiments thereof, wherein reference is made to the accompanying drawings, in which.

Figure 1:
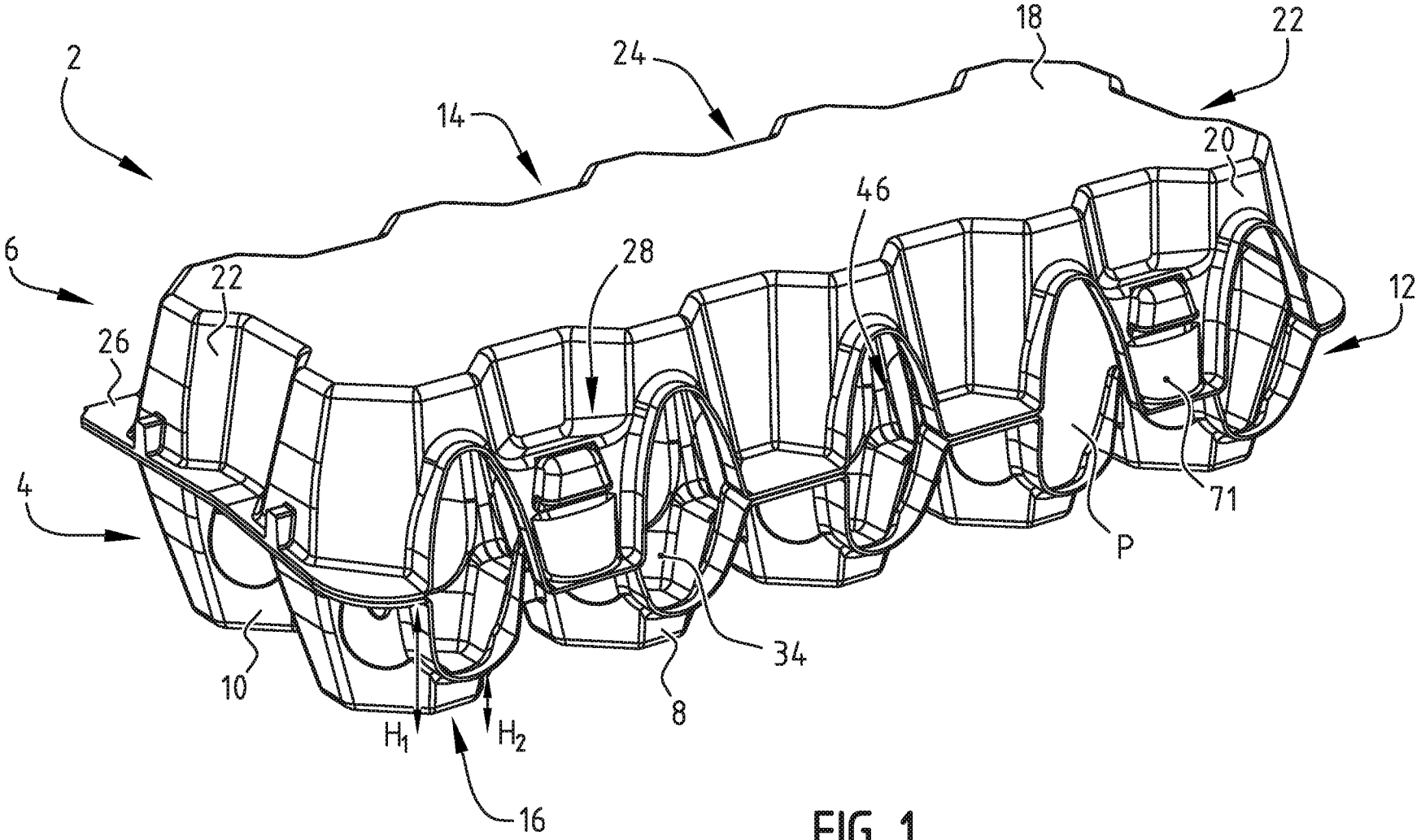
FIG. 1 shows a packaging unit according to the invention in a closed position.

Packaging unit 2 (FIGS. 1-4) comprises bottom part 4 and cover part 6. Bottom part 4 comprises front part/surface 8, first side surface 10, second side surface 12, back surface 14, and bottom surface 16. Cover part 6 comprises top surface 18, front surface 20, first side surface 22, second side surface 22, and back surface 24. Hinge 26 connects back surfaces 14, 24 of bottom part 4 and cover part 6, respectively.

Figure 2:
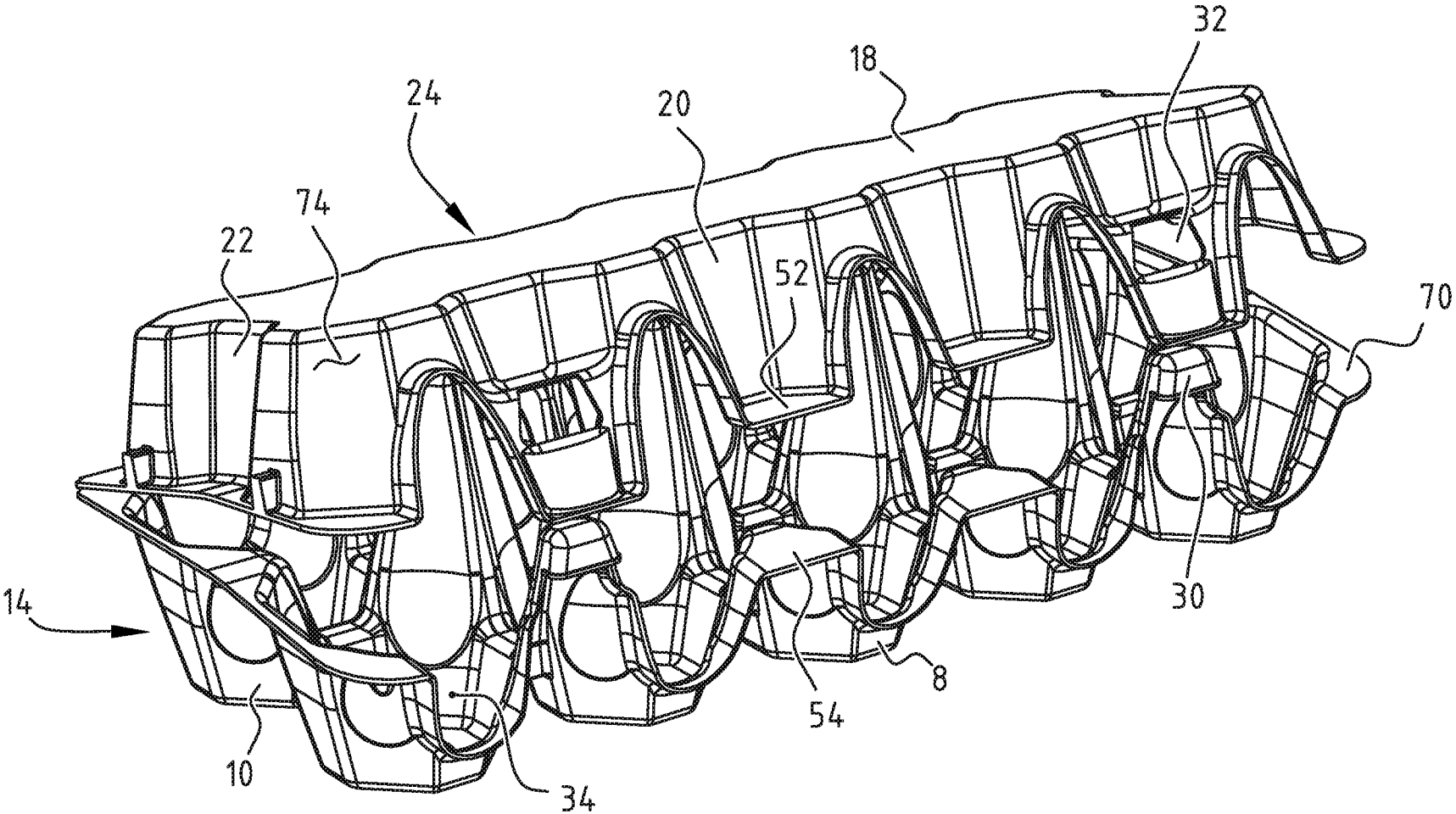
FIG. 2 shows the packaging unit of FIG. 1 in a position between a fully opened and a fully closed position.
Figure 3:
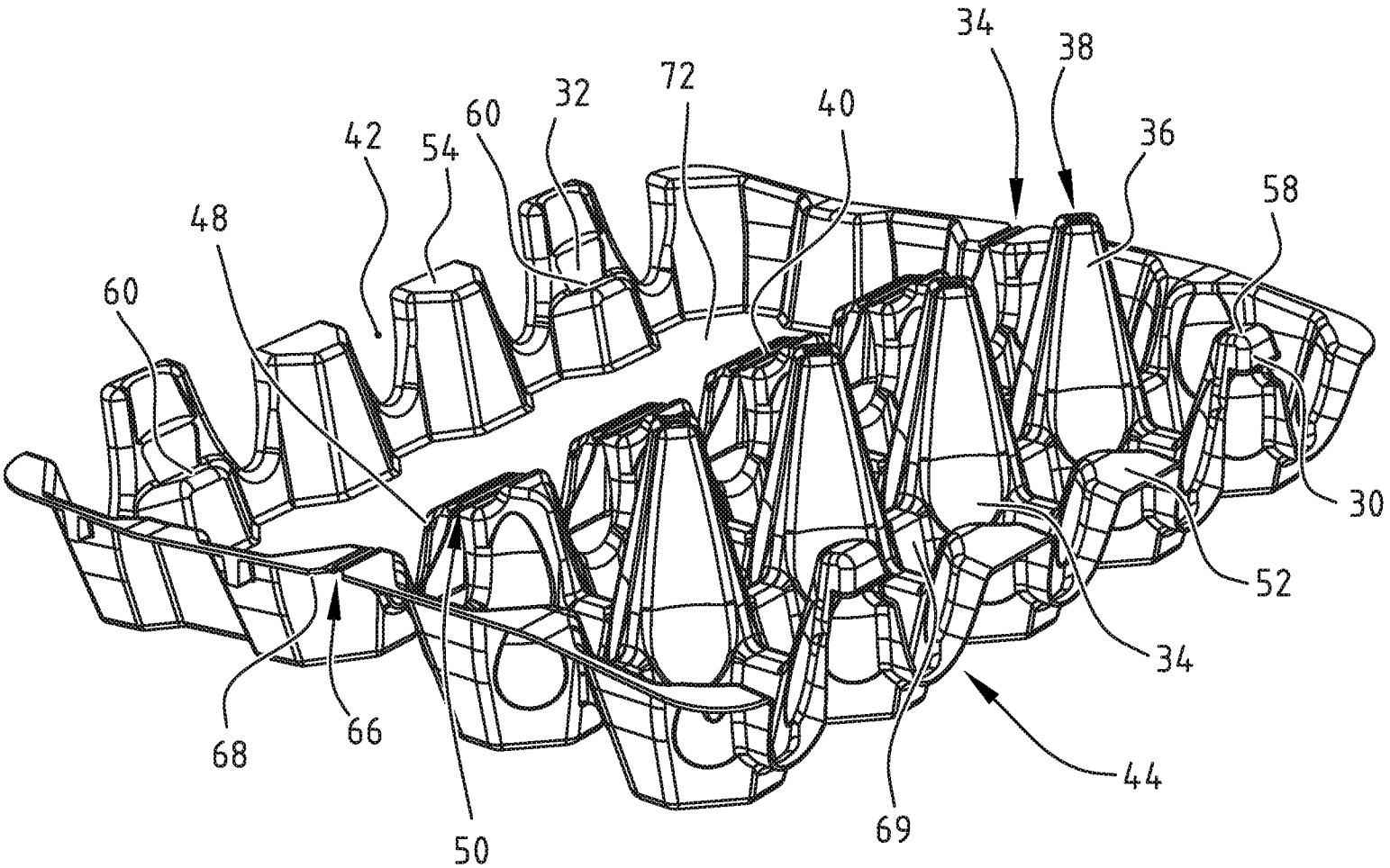
FIG. 3 shows the packaging unit of FIGS. 1 and 2 in a fully opened position.

In a closed position of packaging unit 2 (FIG. 1) front surfaces 8, 20 of bottom part 4 and cover part 6 respectively, are connected using lock 28. In the illustrated embodiment lock 28 comprises cam element 30 in bottom part 4 and opening 32 in cover part 6 (FIGS. 2 and 3).

Compartments 34 are provided in bottom part 4 and are capable of holding product P, such as an egg. Between compartments 34 there are provided a number of cones 36 that extend upwardly. In the illustrated embodiment cones 36 are provided with opening or hole 38.

Height $H_1$ of packaging unit 2 (FIG. 1) is considered at the corner of bottom part 4. Bottom display opening 44 extends over a height $H_1$-$H_2$ in bottom part 4.

In the illustrated embodiment, hinge 26 comprises a number of hinge parts 40. In this illustrated embodiment hinge part 40 are aligned and are interrupted by cover display opening 42 and bottom display opening 44 (FIG. 3) that together define display opening 46 (FIG. 1). In the illustrated embodiment display opening 46 has a shape resembling an egg. It will be understood that other shapes can also be envisaged in accordance to the present invention.

Figure 4:
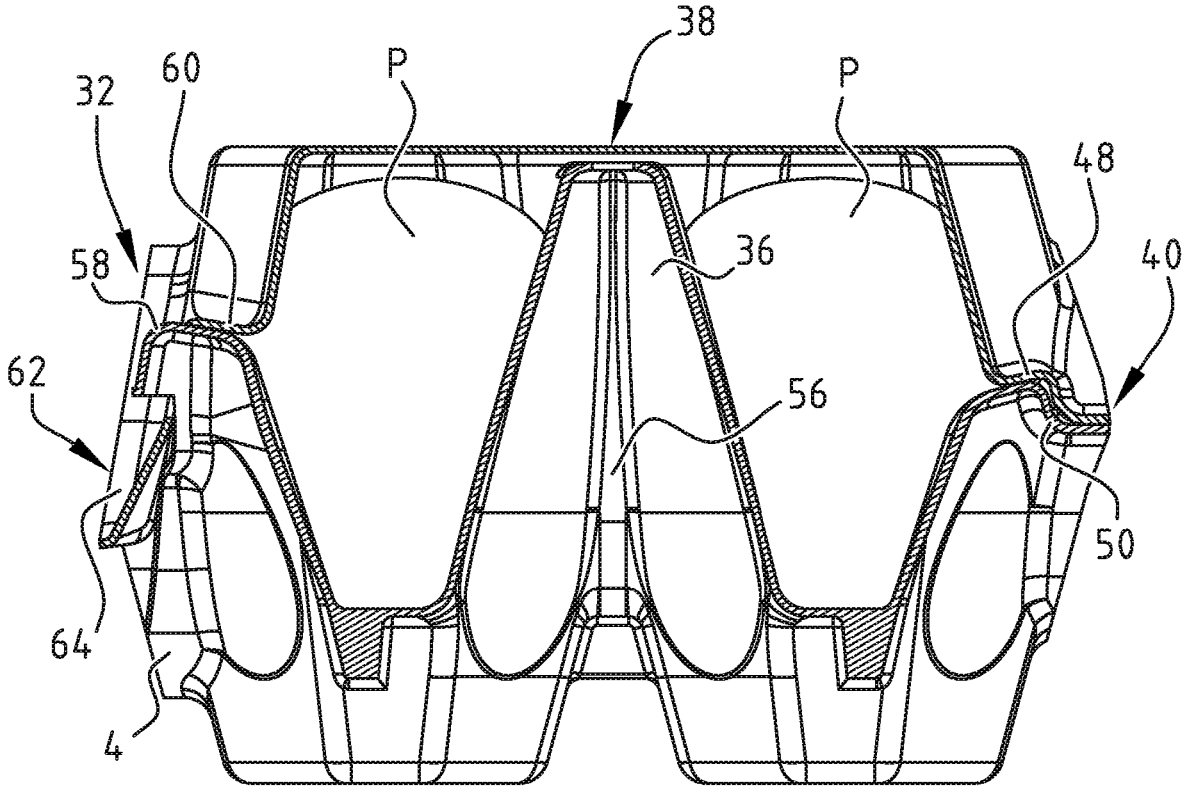
FIG. 4 shows a cross section of the packaging unit of FIGS. 1-3.

Hinge parts 40 comprise a cover support part 48 that in a closed position of packaging unit 2 engages bottom support part 50 (FIG. 4). Furthermore, bottom part 4 comprises bottom support surface 52 and cover part 6 comprises cover support surface 54 (FIG. 2). In a closed position of packaging unit 2 bottom support surface 52 engages cover support surface 54.

In the illustrated embodiment providing opening 38 to cone 36 provides a type of ventilation channel 56 inside of cone 36 (FIG. 4). Furthermore, in this illustrated embodiment cam 30 is provided with a top surface 58 that engages upper edge or support surface 60 of lock opening 32 in a closed position of packaging unit 2 (FIG. 4).

As illustrated, lock 28 preferably remains substantially behind front surface 62 (FIG. 4) defined by edges 64 of bottom part 4 and cover part 6 that emphasise display openings 44 and provide additional strength to packaging unit 2. In the illustrated embodiment hinge 26 further comprises indent 66 with side edges 68 (FIG. 3). Individual compartments 34 are separated from each other by walls or ribs 69 and cones 36.

Packaging unit 2 further comprises edge 70 (FIG. 2) to provide additional support to packaging unit 2. Display extension 71 (FIG. 1) extends in a substantially downward direction from opening 32. On the inside of top surface 8 there is provided print area 72 (FIG. 3). The moulded pulp material is optionally provided with natural fibres 74 (FIG. 2) and/or a biodegradable material. Optionally, natural fibres 74 can be allowed to remain visible on packaging unit 2, 102.

Figure 5:
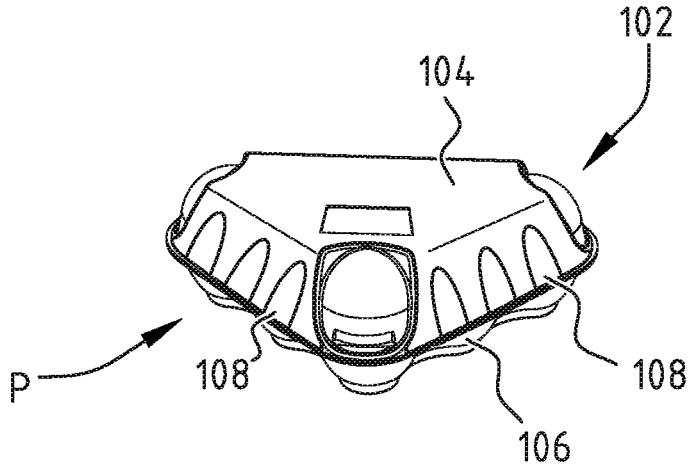
FIG. 5 shows an alternative design of packaging unit according to the present invention.

In the illustrated embodiment packaging unit 2 comprises product receiving compartments 34 are provided in two rows of five compartments 34. It will be understood that other configurations can also be envisaged in accordance to the invention. For example, packaging unit 102 (FIG. 5) comprises cover part 104 and bottom part 106 with a number of display openings 108 enabling a visual view of products P. It will be understood that other designs can also be envisaged in accordance to the present invention.

Figure 6A:
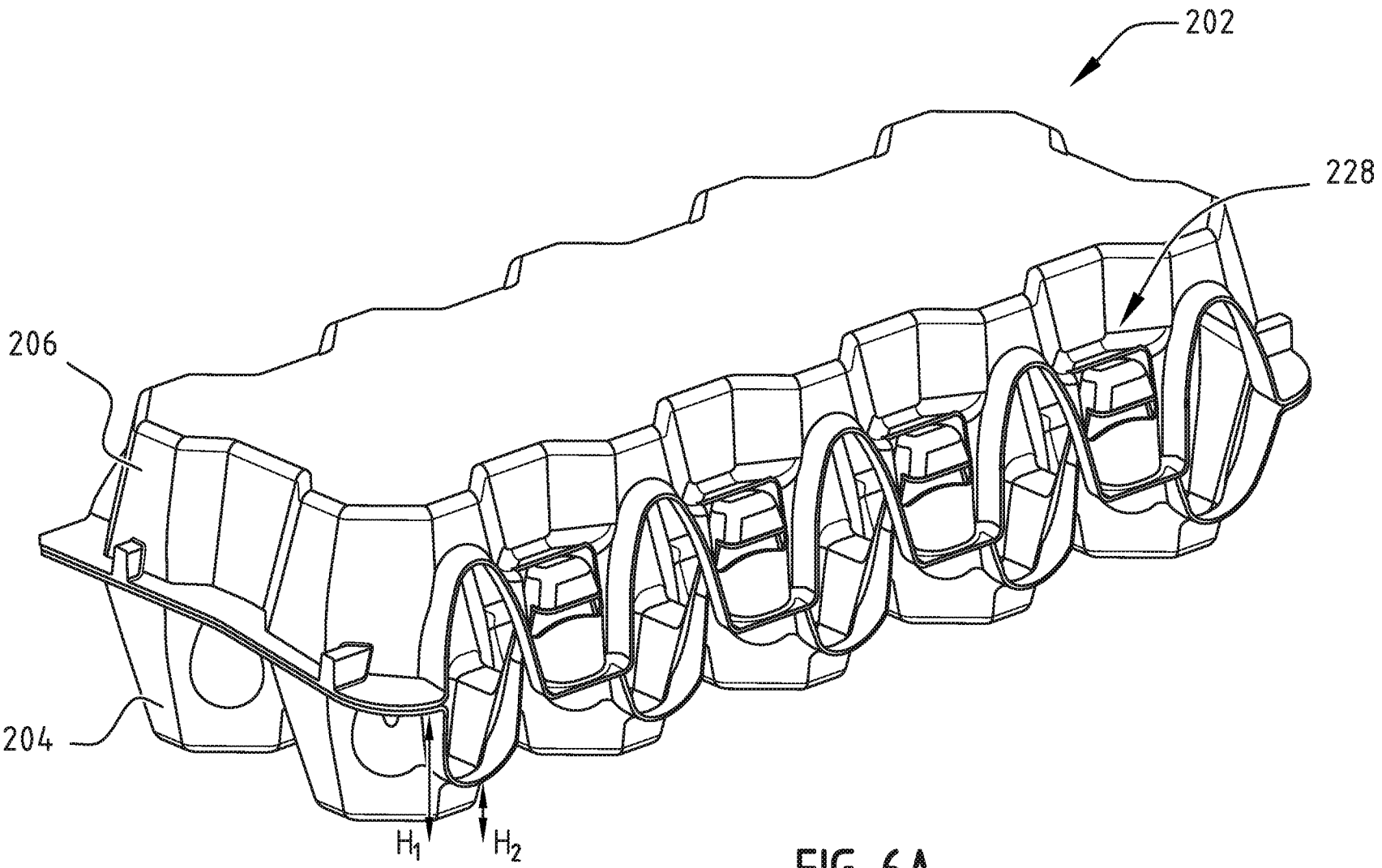
FIGS. 6A and B show an alternative embodiment of the packaging unit according to the invention.
Figure 6B:
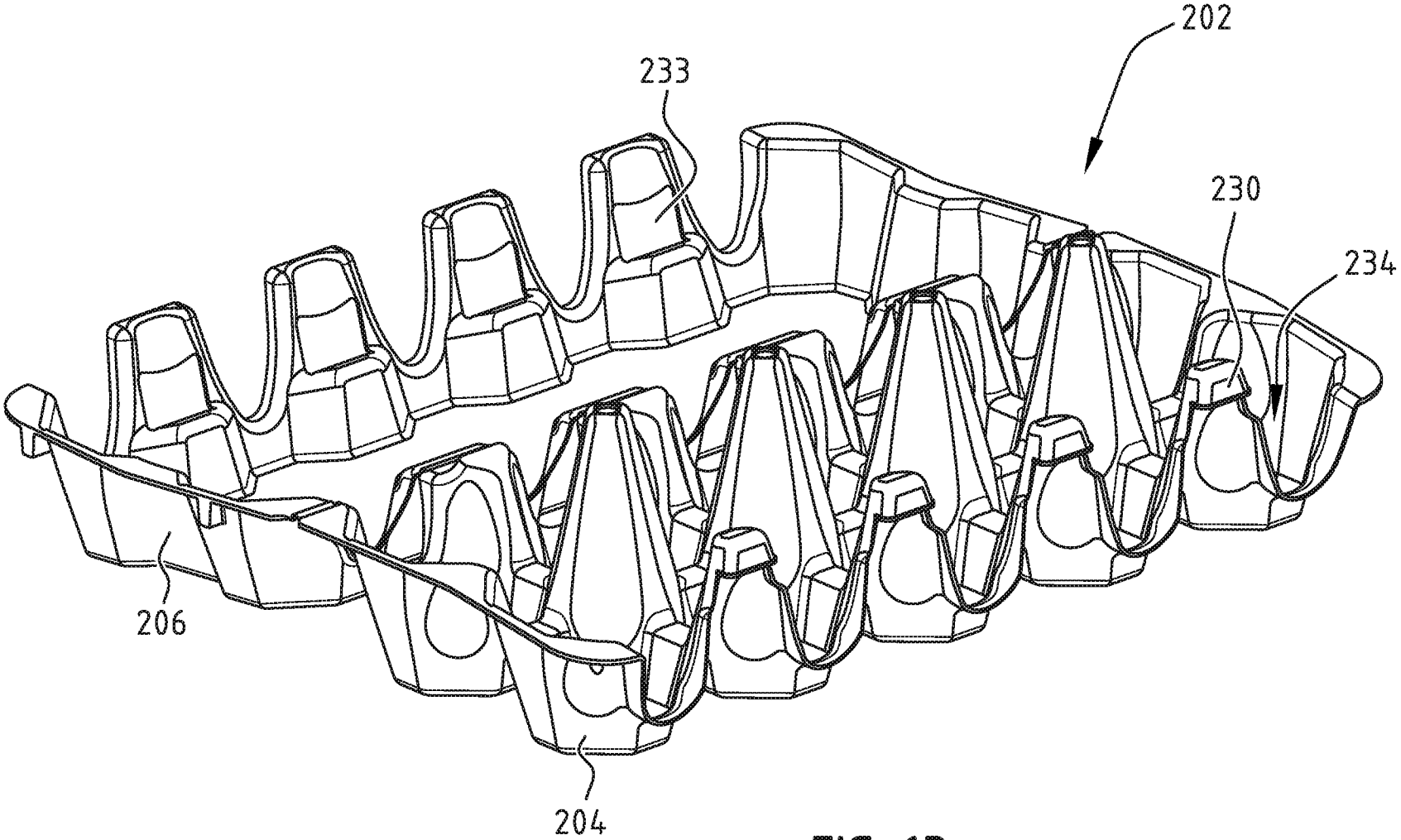

Alternative packaging unit 202 (FIG. 6A-B) has bottom part 204 and cover part 206, and comprises more locks 228 with cams 230 and openings 232. In the illustrated embodiment the number of locks is equal to the number of egg compartments 234 in the front row of packaging unit 202 minus one. This improves the locking between bottom part 204 and cover part 206. Height $H_1$ of packaging unit 202 (FIG. 6A) is considered at the corner of bottom part 204. Bottom display opening 44 extends over a height $H_1$-$H_2$ in bottom part 204.

When manufacturing packaging unit 2, 102 the moulded pulp material is provided to a mould, preferably with the moulded pulp material comprising a number of additives, such as an amount of AKD, ASA and/or other sizing components. In the illustrated embodiment, packaging unit 2, 102 is moulded in a moulding operation and then dried. The dried packaging units 2, 102 are then used to pack products P by placing one product P in respective compartment 34 to provide a packaging unit that is filled with products P and ready for storage, transport and/or display. Such packaging units enables a potential buyer to inspect products P while packaging unit 2, 102 remains on the shelf, for example.

The present invention is by no means limited to the above described preferred embodiments thereof. The rights sought are defined by the following claims, within the scope of which many modifications can be envisaged. For example, lock 28 can be provided with differently shaped locking elements. Furthermore, a label can be attached to packaging unit 2, 102. The illustrated packaging unit 2 comprises ten product receiving compartments 34. It will be understood that another number of product receiving compartments 34 can also be envisaged in accordance with the invention. Although packaging unit 2 is shown for eggs, it may also be used for other products such as kiwis and tomatoes, for example.

The invention claimed is:

1. Packaging unit from a moulded pulp material, the packaging unit comprising:

a bottom part with product receiving compartments for holding respective products, and a number of cones that are provided between the compartments, and having at least one bottom front surface; and a cover part that is hingedly connected to the bottom part with a hinge-element, and having at least one cover display surface, wherein the packaging unit comprises a lock for locking the bottom and cover parts in a closed position, wherein at least one of the bottom front surface and cover display surface comprise a number of display openings that are positioned to display the product in the respective compartment, wherein the display openings in the bottom front surface and cover display surface are aligned, wherein the lock comprises a lock opening and a cam element, wherein the cam element is provided on a flapless front surface of the bottom part, and wherein the at least one cover display surface with the lock comprises a display extension that is positioned substantially below the lock opening and extends outward from the cover display surface, wherein the display extension is configured to guide the cam element into the lock opening.

2. Packaging unit according to claim 1, wherein the aligned display openings resemble an egg-shape.

3. Packaging unit according to claim 2, wherein the display opening in the bottom front surface extends over ⅔ of the height of the bottom part.

4. Packaging unit according to claim 1, wherein in a closed position the lock substantially lies behind a front plane of the packaging unit.

5. Packaging unit according to claim 1, wherein the lock opening comprises a support surface that is configured for engaging the cam element.

6. Packaging unit according to claim 1, wherein the hinge-element comprises a cover support part and a bottom support part.

7. Packaging unit according to claim 1, wherein the bottom part on the display surface comprises a substantially horizontally extending bottom support surface configured for engaging the cover part.

8. Packaging unit according to claim 7, wherein the cover part on the display surface comprises a substantially horizontally extending cover support surface configured for engaging the bottom support surface.

9. Packaging unit according to claim 1, wherein at least some of the cones are provided with one or more openings that are configured to enable a gas stream, such as an air stream, to pass through the openings.

10. Packaging unit according to claim 1, wherein the hinge-element comprises an indent.

11. Packaging unit according to claim 1, wherein the cover part comprises a substantially planar top surface.

12. Packaging unit according to claim 1, wherein the moulded pulp material comprises an amount of natural fibers.

13. Packaging unit according to claim 1, wherein the moulded pulp material comprises an amount of a biodegradable material.

14. Method for packing products comprising the step of providing a packaging unit according to claim 1, and placing therein one or more of the products.

15. Method for manufacturing a packaging unit from a moulded pulp material, the method comprising the steps of:

preparing a moulded pulp material; and providing a packaging unit according to claim 1.

* * * * *